United States Patent [19]

Keller

[11] Patent Number: 4,673,116

[45] Date of Patent: Jun. 16, 1987

[54] SPRING LOADED CLOTHES HANGER

[76] Inventor: Roger L. Keller, 5305 Palmetto, Houston, Tex. 77081

[21] Appl. No.: 921,036

[22] Filed: Oct. 20, 1986

[51] Int. Cl.[4] ..... A47G 25/42

[52] U.S. Cl. ..... 223/94; 211/118; 211/119; 16/295; D6/317

[58] Field of Search ..... 211/113–118, 211/119; 223/90, 89, 94; 16/295; D6/317

[56] References Cited

U.S. PATENT DOCUMENTS

| | | | |
|---|---|---|---|
| 672,777 | 4/1901 | Johnson | 223/94 |
| 1,066,170 | 7/1913 | Wesner | 223/94 |
| 1,495,425 | 5/1924 | Moss | 223/94 |
| 1,769,076 | 7/1930 | Shrack | 223/94 |
| 2,137,700 | 11/1938 | Reehl | 223/94 |
| 2,435,301 | 2/1948 | Wingate | 223/94 |
| 2,440,636 | 4/1948 | Lowe | 223/94 |
| 2,569,726 | 10/1951 | McPherson | 223/94 |
| 2,586,913 | 2/1952 | Burns | 223/94 |
| 2,595,026 | 4/1952 | Varker | 223/94 |
| 2,716,514 | 8/1955 | Braunstein | 223/94 |
| 2,754,038 | 7/1956 | Varker | 223/94 |
| 3,315,854 | 4/1967 | Glisson et al. | 223/94 |

*Primary Examiner*—Werner H. Schroeder
*Assistant Examiner*—Andrew M. Falk
*Attorney, Agent, or Firm*—Fulbright & Jaworski

[57] ABSTRACT

A clothes hanger having a first and second member. The first member has a supporting hook, a circular hinge section and a first supporting arm. The second member has a second supporting arm and a pivoting axle extending through the circular section for allowing the arms to move downwardly towards each other and a stop engagable with the top of the first supporting arm for limiting the extent of upward movement of the arms. A spring between the first and second members yieldably urges the first and second arms upwardly and away from each other to cause the stop to engage the first arm for supporting a garment from the arms, but allows the garment to be pulled downwardly and off of the hanger by causing movement of the arms downwardly and towards each other.

5 Claims, 3 Drawing Figures

SPRING LOADED CLOTHES HANGER

BACKGROUND OF THE INVENTION

Clothes hanging on hangers are sometimes damaged or buttons popped as the clothes are pulled from the hangers. Hangers having spring biased arms have been proposed in various United States patents to overcome this problem by allowing the supporting arms to contract thereby facilitating the removal of the clothes from the arms. However, such prior art devices have been expensive, have been complicated, and have not met with public approval.

The present invention is directed to a spring loaded clothes hanger which is inexpensive to manufacture, simple in construction and operation, and easy to use.

SUMMARY

The present invention is directed to a spring loaded clothes hanger having a first member and a second member. The first member includes a supporting hook, a circular hinge section and a first supporting arm. The second member includes a second supporting arm, a pivoting axle extending through the circular section of the first member for allowing the arms to move relative to each other, and a stop engagable with the top of the first supporting arm for limiting the extent of upward movement of the arms. Spring means are positioned between the first and second members yieldably urging the first and second arms upwardly and away from each other to cause the stop to engage the first arm and allow the arms to support a garment therefrom but allows the arms to contract towards each other and release the garment.

Still a further object of the present invention is the provision of a protective shield extending outwardly from the axle beyond the spring and stop for protecting clothes from snagging thereon.

Yet a further object of the present invention is the provision of an integral first member and integral second member. The first member includes a supporting hook, a circular hinge section connected to the hook and having an axis perpendicular to a plane containing the hook and a first clothes supporting arm connected at right angle to the hinge section. The second member includes a second clothes supporting arm, a pivoting axle connected perpendicular to the second arm and extending through the circular hinge of the first member, and an L-shaped stop connected perpendicular to the axle and engagable with the top of the first arm. Spring means are supported by the axle and yieldably engage the first and second arms to urge them upwardly and away from each other to cause the stop to engage the top of the first arm for supporting a garment but allowing the arms to move towards each other to release the garment.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
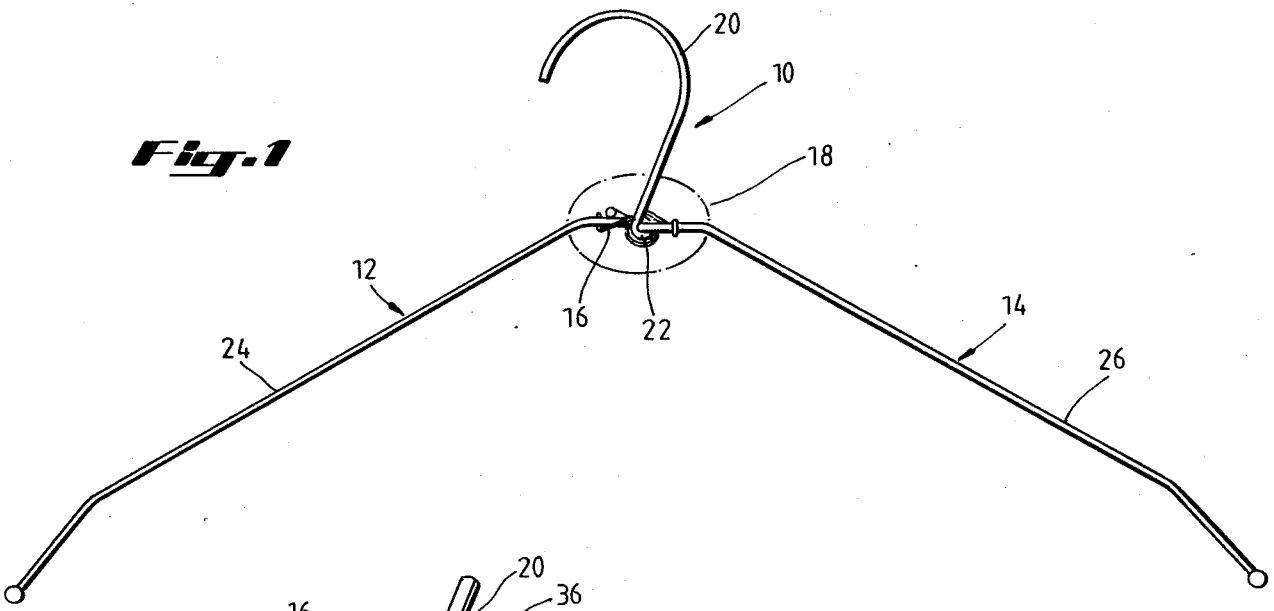
FIG. 1 is an elevational view of the present invention.

Referring now to the drawings, and particularly to FIG. 1, the reference numeral 10 generally indicates the spring loaded clothes hanger of the present invention and includes an integral first member generally indicated by the reference numeral 12, an integral second member generally indicated by the reference numeral 14, a spring 16, and, if desired, a protective shield 18.

Figure 3:
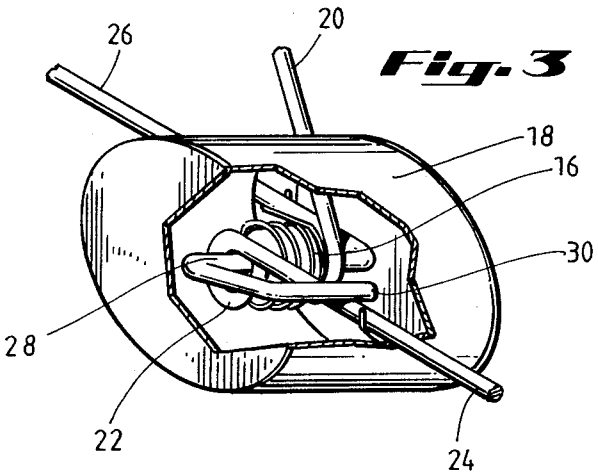
FIG. 3 is an enlarged fragmentary perspective view, partly in section, illustrating the hanger section of the present invention from the side opposite that shown in FIG. 2.
Figure 2:
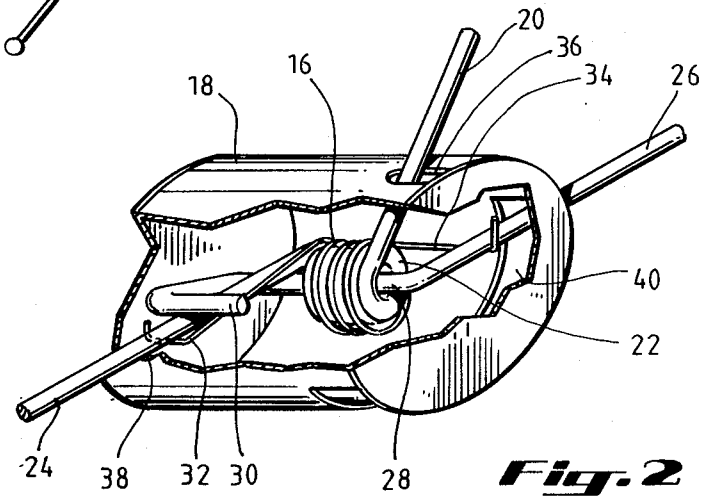
FIG. 2 is an enlarged fragmentary perspective view, partly in section, illustrating one side of the hinge section of the present hanger.

Referring now to FIGS. 1, 2 and 3, the first member 10 includes a supporting hook 20 for supporting the hanger 10 from a conventional clothes rod. A circular hinge section 22 is connected to the hook 20 and has an axis perpendicular to a plane containing the hook 20 and includes one or more circular loops for forming a hinge. A first clothes supporting arm 24 is connected to the hinge 22 at right angles to the axis of hinge 22.

The second member 14 includes a second clothes supporting arm 26, a pivoting axle 28 (FIGS. 2 and 3) connected perpendicular to the second arm 26 and extending through the circular hinge 22 of the first member 12 for allowing the arms 24 an 26 to move relative to each other. A stop, such as L-shaped member 30, is connected to the axle and is engagable with the top of the first arm 24 for limiting the extent of the upward movement of the arms 24 and 26, but allowing the arms to move downwardly and towards each other.

A spring 16 is preferably wound about the axle 28 and includes a first end 32 engaging the underside of the arm 24 and a second end 34 engaging the underside of the arm 26. The spring 16 yieldably urges the first and second arms 24 and 26 upwardly and away from each other to cause the stop 30 to engage the top of the first arm 24 allowing the arms to support a garment concomitantly allowing the arms to move towards each other to release the garment.

If desired, a protective shield 18 may be utilized to enclose the axle 28, hinge 22, spring 16 and stop 30. For example, the shield 18 may be a cylinder enclosing the axle 28, hinge 22, spring 16 and stop 30 for protecting the clothes from snagging on these parts. The cylinder 18 includes an opening 36 through which the hook 20 extends, an opening 38 through which the first arm 24 extends and a groove 40 through which the second arm 26 may rotate relative to the first arm 24.

In use, the hanger 10 will normally be in the position shown in FIG. 1. By gripping the top ends of the arms 24 and 26 they may be easily compressed and inserted into the neck of a clothes garment and will, when released, expand outwardly by the action of the spring 22 until the stop 30 engages the top of arm 24. In this position the strength of the spring 16 is sufficient to hold the arms 24 and 26 extended and support clothes therefrom. While the hanger 10 may be released from a garment by again gripping and moving the arms 24 and 26 towards each other, a garment can be removed by merely pulling the garment away from the hook 20 and overcoming the biasing force of the spring 16 without damaging the clothes or ripping buttons therefrom.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art, and which are encompassed within the spirit of the invention and the scope of the appended claims.

What is claimed is:

1. A spring loaded clothes hanger comprising, a first member and a second member, said first member having a supporting hook, a circular hinge section and a first supporting arm, said second member having a second supporting arm, a pivoting axle extending through the circular section of the first member for allowing the arms to move relative to each other, and a stop engagable with the top of the first supporting arm for limiting the extent of upward movement of the arms, and spring means between the first and second members yieldably urging the first and second arms upwardly and away from each other to cause the stop to engage the first arm for supporting a garment but allowing the arms to move toward each other and release the garment.

2. The clothes hanger of claim 1 including, a protective shield extending outwardly from the axle beyond the spring and stop for protecting clothes from snagging thereon.

3. The clothes hanger of claim 1 wherein the spring means is coiled about the axle.

4. A spring loaded clothes hanger comprising, an integral first member and an integral second member, said first member having a supporting hook, a circular hinge section connected to the hook and having an axis perpendicular to a plane containing the hook, and a first clothes supporting arm connected at right angle to the axis of the hinge section, said second member having a second clothes supporting arm, a pivoting axle connected perpendicular to the second arm and extending through the circular hinge of the first member for allowing the arms to move relative to each other, and an L-shaped stop connected perpendicular to the axle and engagable with the top of the first arm for limiting the extent of the upward movement of the arms, and spring means supported by the axle and engaging and yieldably urging the first and second arms upwardly and away from each other to cause the stop to engage the first arm for supporting a garment but allowing the arms to move toward each other to release the garment.

5. The clothes hanger of claim 4 including a protective cover enclosing the hinge, spring and stop for protecting clothes from snagging thereon.

* * * * *